United States Patent [19]

Johnson

[11] Patent Number: 4,543,890

[45] Date of Patent: Oct. 1, 1985

[54] WOOD FUEL COMBUSTION SYSTEM

[76] Inventor: Theodore J. Johnson, Box 104, Rte. 1, Toivola, Mich. 49965

[21] Appl. No.: 570,691

[22] Filed: Jan. 13, 1984

[51] Int. Cl.[4] ..... F23K 3/00

[52] U.S. Cl. ..... 110/102; 110/108; 110/208; 110/210; 110/233; 110/255; 110/268; 110/293

[58] Field of Search ..... 110/102, 108, 116, 208, 110/210, 211, 214, 233, 255, 256, 259, 268, 293, 327, 328

[56] References Cited

U.S. PATENT DOCUMENTS

| | | | |
|---|---|---|---|
| 1,240,749 | 9/1917 | Matthews | 110/116 |
| 2,165,802 | 7/1939 | Longtin | 110/102 |
| 3,774,555 | 11/1973 | Turner | 110/210 |
| 4,128,065 | 12/1978 | Kelly et al. | 110/211 |
| 4,254,715 | 3/1981 | LaHaye et al. | 110/214 |
| 4,300,456 | 11/1981 | Messersmith | 110/102 |
| 4,366,802 | 1/1983 | Goodine | 110/116 |
| 4,414,904 | 11/1983 | Foster | 110/102 |
| 4,424,755 | 1/1984 | Caffyn et al. | 110/211 |
| 4,463,687 | 8/1984 | Zimmerman et al. | 110/233 |

*Primary Examiner*—Albert J. Makay
*Assistant Examiner*—Steven E. Warner

[57] ABSTRACT

A furnace adapted to burn wood chips and wood particles and including an inner cylinder adapted to be positioned in horizontal relation and including a primary combustion area. A funnel assembly is provided for supporting a quantity of wood particles and for funneling the wood particles into the primary combustion area of the inner cylinder. A second cylinder is also provided, the second cylinder having a length greater than that of the inner cylinder and having one end which surrounds the inner cylinder such that the inner cylinder and the second cylinder define an air space therebetween. The other end of the second cylinder defines a secondary combustion area where the combustion gases from the primary combustion area are mixed with secondary air.

21 Claims, 8 Drawing Figures

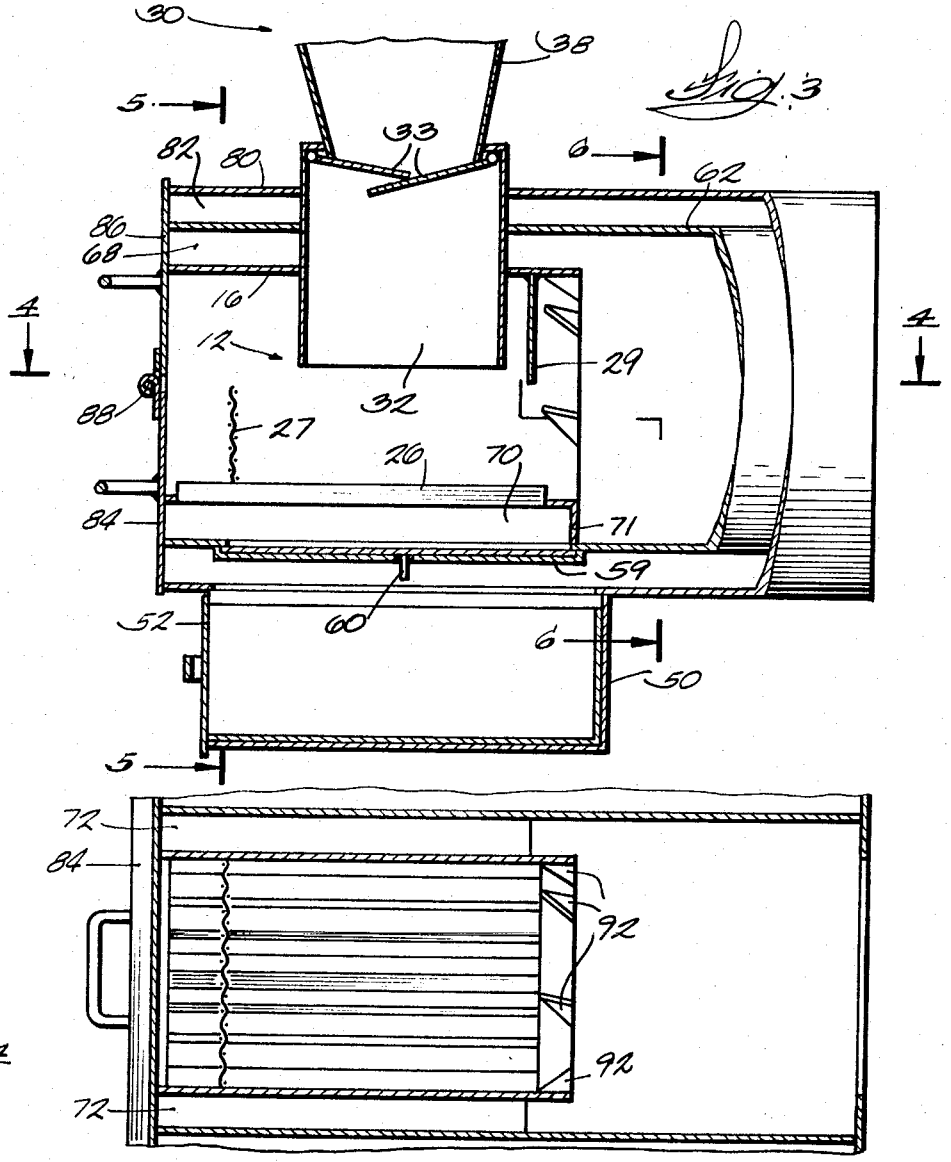
Fig. 3
Fig. 4
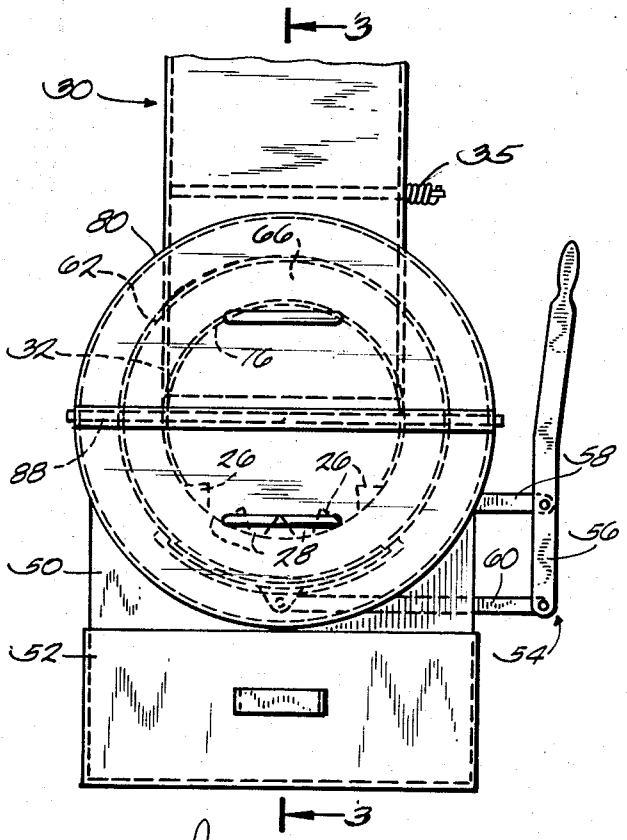
Fig. 2

WOOD FUEL COMBUSTION SYSTEM

FIELD OF THE INVENTION

The present invention is directed to a furnace for use in burning wood chips and other particulate material for producing a source of heat.

BACKGROUND PRIOR ART

In many areas waste wood products are abundant and far less expensive as fuel than fossil fuels if the wood products can be burned efficiently. On the other hand, waste wood is a relatively bulky fuel and is difficult to handle and to feed into a furnace. Wood is also difficult to burn efficiently due to the handling problems associated with feeding the wood into the furnace and the difficulties of providing uniform feeding of fuel into the furnace as well as providing efficient and consistent combustion of the wood.

SUMMARY OF THE INVENTION

The present invention provides an efficient apparatus for burning waste wood chips or wood particles to produce a source of heat. The apparatus of the invention provides an improved means for feeding wood chips or wood particles into a furnace and an improved furnace construction which provides for an efficient and consistent burning of the wood cnips. The wood burning furnace embodying the invention also comprises a relatively simple and compact construction which can be manufactured relatively inexpensively.

The wood burning furnace embodying the invention can also be manufactured in various sizes depending on the heat output required and the application of the furnace. For example, a relatively small unit can be employed for home heating whereas a much larger unit can be used for industrial applications. These furnaces, whether for use in home heating applications or in industrial applications, have substantially the same construction but with components being sized in proportion to the intended application of the furnace.

More particularly, the invention includes a furnace adapted to burn wood chips and wood particles, the furnace including an inner cylinder adapted to be positioned in horizontal relation and including a primary combustion area. A funnel assembly is also provided for supporting a quantity of wood particles and for funneling the wood particles into the primary combustion area of the inner cylinder. A second cylinder is also provided, the second cylinder having a length greater than that of the inner cylinder and having one end which surrounds the inner cylinder such that the inner cylinder and the second cylinder define an air space therebetween. The other end of the second cylinder defines a secondary combustion area where the combustion gases from the primary combustion area are mixed with secondary air.

One of the features of the invention is the provision of a means for controlling air flow through the inner cylinder from the air intake end to the hot air discharge end.

Another of the features of the invention is the provision of a means for controlling air flow through the air space between the inner cylinder and the second cylinder.

In one embodiment of the invention the primary combustion area of the inner cylinder includes a lower portion having a plurality of air flow passages between the lower portion of the air space and the combustion zone for providing air flow from the lower portion of the air space between the inner cylinder and the second cylinder and into the primary combustion area.

In one embodiment of the invention the means for controlling air flow through the inner cylinder from the air intake to the hot air exhaust opening comprises a door hingedly mounted adjacent the air intake of the inner cylinder and moveable between an open position, permitting air flow through the air intake into the inner cylinder, and a flow restricting position.

Another principal feature of the invention is the provision of means for providing air flow from the upper portion of the air space between the inner cylinder and the second cylinder into the secondary combustion area of the second cylinder to mix with exhaust gases from the primary combustion area and to cause combustion of exhaust gases in the secondary combustion area.

In one embodiment of the invention a third cylinder surrounds the second cylinder and is spaced outwardly from the second cylinder to define an air space between the second cylinder and the third cylinder.

In one preferred embodiment of the invention the container includes at least a pair of generally funnel shaped containers positioned in vertically stacked relation, the pair of funnel shaped containers including a lower container for supporting a first quantity of wood particles and an upper container for containing a second quantity of wood particles, the upper container being positioned on top of the lower container in vertically stacked relation.

Various other features and advantages of the invention will be apparent by reference to the following description of a preferred embodiment, from the drawings, and from the claims.

BRIEF DESCRIPTION OF THE DRAWINGS

FIG. 2 is an enlarged end elevation view of the furnace shown in FIG. 1.

FIG. 3 is a cross-section view taken along line 3—3 in FIG. 2.

FIG. 4 is a cross-section view taken along line 4—4 in FIG. 3.

Figure 1:
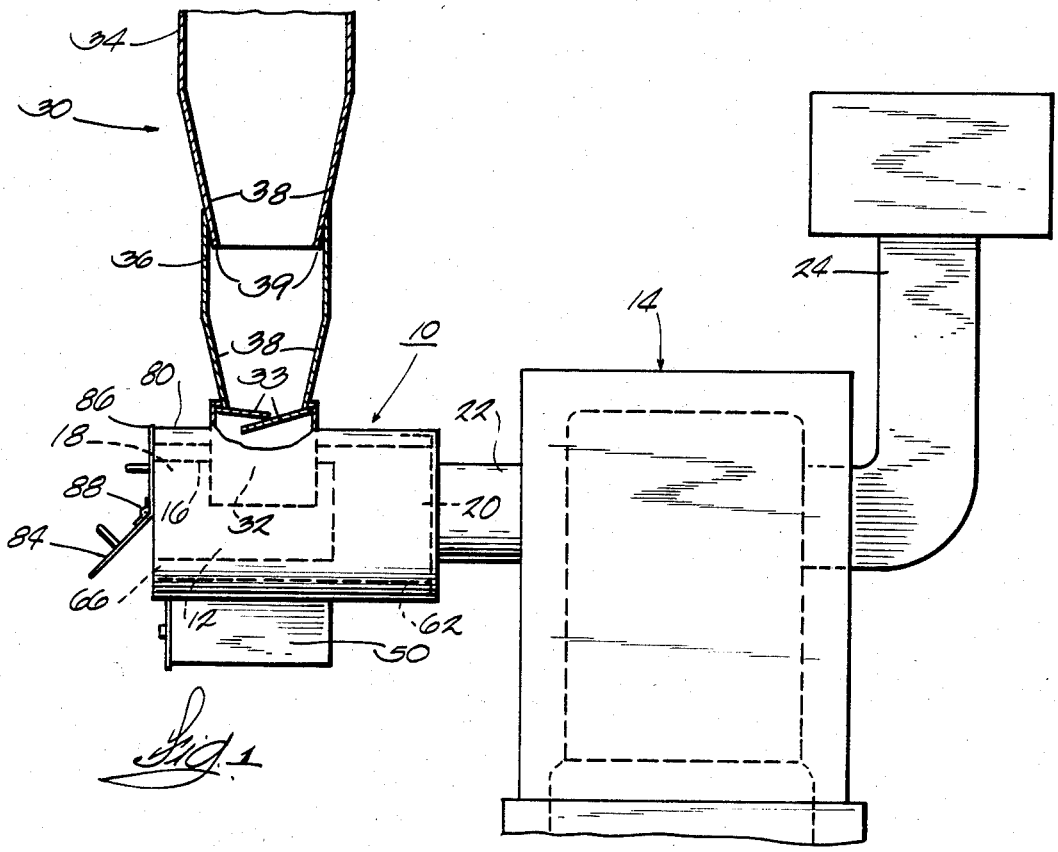
FIG. 1 is a side elevation view of a wood burning surface embodying the invention connected to a heating system.

Before describing a preferred embodiment of the invention, it is to be understood that the invention is not limited in its application to the details of construction nor to the arrangement of the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF A PREFERRED EMBODIMENT

Illustrated in FIG. 1 is a furnace 10 embodying the present invention and including a primary combustion area 12 for receiving wood particles wherein the wood particles can be burned and a secondary combustion area 20 wherein exhaust gases from the primary combustion area are mixed with preheated air to cause further combustion of the exhaust gases. In the illustrated construction the furnace 10 is shown as being connected to a conventional heating system 14. The furnace 10 can also be used to provide heat in a variety of other applications. For example, the furnace 10 could be used as a means for providing heat for a hot air heating system or another home heating application as well as a source of heat for powering a boiler, steam generator, or a number of other industrial applications.

The furnace 10 includes a central or inner cylinder 16 comprised of an open-ended metal cylinder. The cylinder 16 is supported in a generally horizontal relation and includes one end 18 adapted to be an air inlet for the primary combustion area 12. The secondary combustion area 20 is adapted to be connected to the heating device 14 referred to above by a conduit or pipe 22. In the illustrated application, the hot air will flow through the heater 14 and will then be discharged through a conventional exhaust stack 24 as commonly used on a furnace.

The inner cylinder 16 is intended to house the primary combustion area or zone 12 where wood particles or wood chips are to be burned. In the illustrated construction the lower portion of the combustion area 12 of the inner cylinder 16 is comprised of a grate 26 (FIG. 2) for supporting wood chips or wood particles. The grate 26 is provided with a plurality of openings 28 adapted to provide for air flow into the combustion area 12 of the inner cylinder 16 and to facilitate combustion of the wood chips or wood particles in the combustion zone.

Means are also provided for supplying wood particles or wood flakes to the combustion chamber 12 of the inner cylinder 16. This means includes a funnel assembly 30 for housing wood chips and having a lower end comprising a chute 32 opening into an upper portion of the combustion chamber 12 of the inner cylinder 16. The funnel assembly 30 is adapted to hold a large supply of wood chips and to deposit them in a controlled manner into the combustion chamber 12 so as to provide a uniform and continuous supply of wood chips to the combustion chamber.

Means are also provided for controlling the flow of wood particles from the funnel assembly 30 into the chute 32 and into the combustion chamber 12. While various means could be provided, in the illustrated construction, a pair of hinged plates 33 are provided adjacent the bottom of the chute 32. The hinged plates 33 are supported by springs 35 so as to control flow of wood particles into chute 32. The springs 35 tend to bias the plates 33 toward the position shown in FIGS. 1 and 3 but are moved downwardly to an open position by the weight of wood chips in the bin 30.

In a preferred form of the invention, the funnel assembly 30 will have a modular construction and include a plurality of funnel units 34 and 36 stacked one on top of the other. The funnel units are constructed of increasing size from bottom to top, i.e. the funnel unit 36 at the bottom of the funnel assembly is smaller in horizontal cross-sectional area than the funnel unit 34 positioned above that bottom funnel assembly.

In a preferred form of the invention each of the funnel units 34 and 36 include lower portions having generally planar sidewalls 38 which slope downwardly and inwardly so as to converge at their lower ends 39. The funnel units are constructed such that the lower end of an upper funnel unit 34 can be positioned in nesting relation in the upper end of the supporting funnel unit 36. In a preferred form of the invention the funnel units 34 and 36 are also constructed such that the sloping sidewalls of the lower portion of the upper unit will define an angle of approximately thirty degrees with respect to a vertical plane. It has been found that by constructing the funnel unit such that the angle between these overlapping surfaces is approximately thirty degrees, the wood chips or wood particles supported by the funnel assembly do not tend to become clogged and are relatively free flowing so as to provide a relatively uniform and continuous supply of wood chips or wood particles to the combustion area. The flow of wood chips into the combustion area can also be facilitated by coating the interior surfaces of the funnel units with conventional high molecular weight polymer coatings having very low coefficients of friction.

In the illustrated arrangement the wood chips or wood particles burned in the combustion area are restrained by a screen 27 and a vertical grate 29.

Means are also provided for receiving ashes from the combustion area 12 as the wood chips are burned. In the illustrated arrangement, this means is comprised of an ash box 50 positioned immediately below the grate of the combustion area. In the particular embodiment of the construction illustrated, the ash box 50 is provided with a drawer 52 which is adapted to receive or collect ashes and which can be slideably removed such that it can be emptied. While other embodiments of the invention could have other constructions, in the illustrated arrangement a shaker assembly 54 is also provided for causing ashes to fall through the grate 26 into the ash box 50. In the illustrated arrangement shown in FIG. 5 the shaker assembly is comprised of a lever or handle 56 pivotably joined to a support arm 58. The lower end of the lever 56 is connected to movable grate 59 by a linkage 60.

Figure 5:
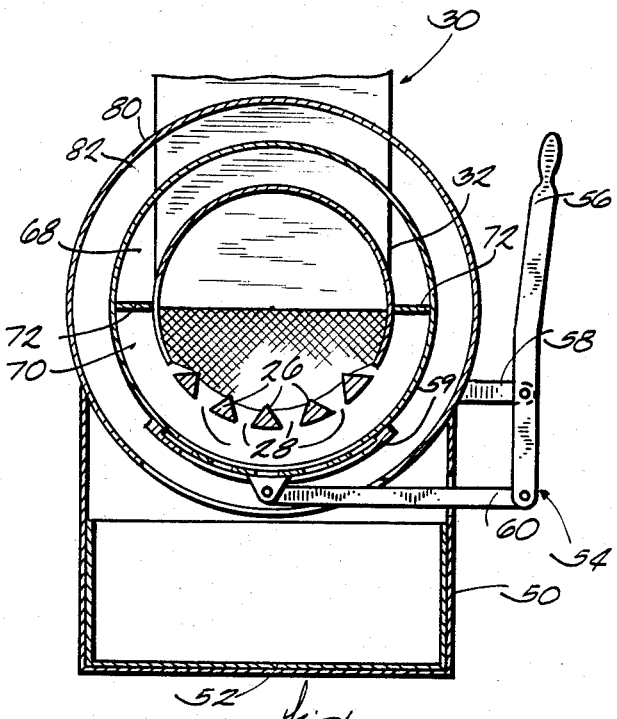
FIG. 5 is a cross-section view taken along line 5—5 in FIG. 3.
Figure 6:
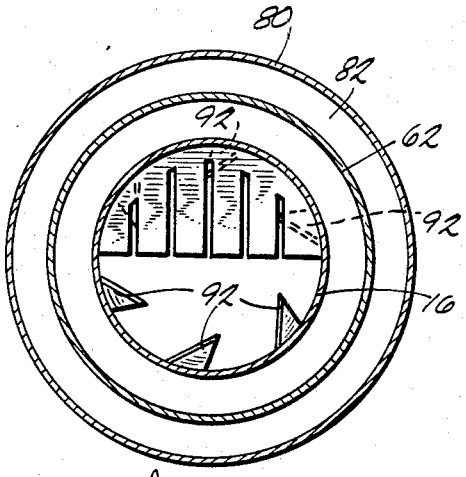
FIG. 6 is a cross-section view taken along line 6—6 in FIG. 3.

The furnace 10 also includes a second cylinder 62 having one end surrounding the inner cylinder 16 such that the inner cylinder 16 and the second cylinder 62 have a common longitudinal axis, and an opposite end of the second cylinder projects or extends beyond the inner cylinder 16 and forms the secondary combustion area 20. The second cylinder 62 has a diameter greater than that of the inner cylinder 16 so as to define an air space or passage 66 between the inner cylinder 16 and the second cylinder 62. Means are also provided for dividing the air passage 66 surrounding that portion of the inner cylinder 16 between the air inlet end 18 and the combustion chamber 12 into an upper air passage portion 68 and a lower air passage portion 70 (FIG. 5). In the illustrated construction this means for dividing the air passage 66 is comprised of a pair of elongated generally horizontally disposed plates 72, one of the plates 72 extending from one side of the inner cylinder 16 to the second cylinder 62 and the other plate extending from the other side of the inner cylinder 16 to the second cylinder 62. In the illustrated arrangement, the plates 72 define a horizontal plane, and the plates 72 can be secured in place by welding the plates to both the inner cylinder 16 and the second cylinder 62. In the illustrated construction the lower air passage 70 is terminated by an end wall 71 extending through an arc from one of the plates 72 to the other plate 72, the end wall 71 being welded in place.

In a preferred form of the invention, the furnace 10 also includes an outer cylinder 80 having a common longitudinal axis with the inner cylinder 16 and the second cylinder 62 and surrounding the second cylinder so as to define an air space 82 between the second cylinder 62 and the outer cylinder 80. The outer cylinder is intended to provide a heat shield and to provide a confined air space around the second cylinder so as to restrict heat loss from the furnace except for the hot exhaust gases discharged into the heater 14.

Means are also provided for controlling the air flow through the inlet end 18 of the inner cylinder 16 to the combustion chamber 12 and for also controlling air flow through the air space 70 between the inner cylinder 16 and the second cylinder 62. While various means could be provided for controlling air flow, in the illustrated construction, this means includes a plate or door 84 hinged to the inlet end of the inner cylinder 16. This plate or door 84 is positioned and hinged in such a manner that it functions to control the air flow through the inner cylinder 16 and through the lower air space 70 between the inner cylinder and the second cylinder. The means for controlling air flow also includes a second plate or hinged door 86 positioned immediately above the first door and controlling the air flow through an upper portion of the inner cylinder 16 and through the upper air flow space 68 between the inner cylinder 16 and the second cylinder 62. While the hinged doors 84 and 86 could have various constructions and be supported in various ways, in the illustrated arrangement, they each comprise a semi-circular plate, the plates being hingedly joined together by a hinge 88 having a longitudinal axis bisecting the inner cylinder 16 and lying in a horizontal plane.

In operation of the furnace, primary air will flow through the air inlet end 18 of the inner cylinder 16 into the combustion zone 12, and air will also flow through the lower half 70 of the air space between the inner cylinder and second cylinder. Since the lower half 70 of the air space terminates in end wall 71, the air flowing through the lower half 70 of the air space will flow upwardly through the grate 26 of the lower portion of the inner cylinder 16 in the area of the combustion zone 12 to aid in combustion of the wood chips.

Means are also provided for causing a flow of heated air into the secondary combustion area 20 to provide for additional air to be mixed with the combustion gases and thereby accomplish secondary burning of the fuel in the exhaust gases. This secondary air flows through the upper half or upper portion 68 of the air space between the inner cylinder and the second cylinder and flows over the inner cylinder 16 toward the secondary combustion area 20. As this secondary air flows over the inner cylinder 16, it is heated, and it can then flow into the secondary combustion area 20 to mix with the combustion gases. Mixing of the heated secondary air with the combustion gases causes further combustion of the volatile components of the combustion gases. This secondary combustion functions to increase the efficiency of operation of the furnace and reduces the combustible products discharged in the exhaust gases.

In the illustrated construction means are also provided for causing turbulence of the gases flowing through the discharge end of the inner cylinder 16. This means for causing turbulence functions to cause mixing of the exhaust gases and the secondary air in the secondary combustion area 20 to thereby facilitate secondary combustion of the volatile materials in the exhaust gases. While various means could be provided for causing such turbulence, in the illustrated arrangement this means is provided by a plurality of fins 92 extending radially inwardly from the inner surface 94 of the inner cylinder 16, and positioned such that as the air flows through the discharge end of the inner cylinder 16, the gases will impinge on the fins thereby generating turbulence. A plurality of fins like fins 92 can also be mounted between the discharge end of the inner cylinder 16 and the second cylinder to cause turbulence of the air flowing over the inner cylinder 16 and into the secondary combustion area 20.

Figure 7:
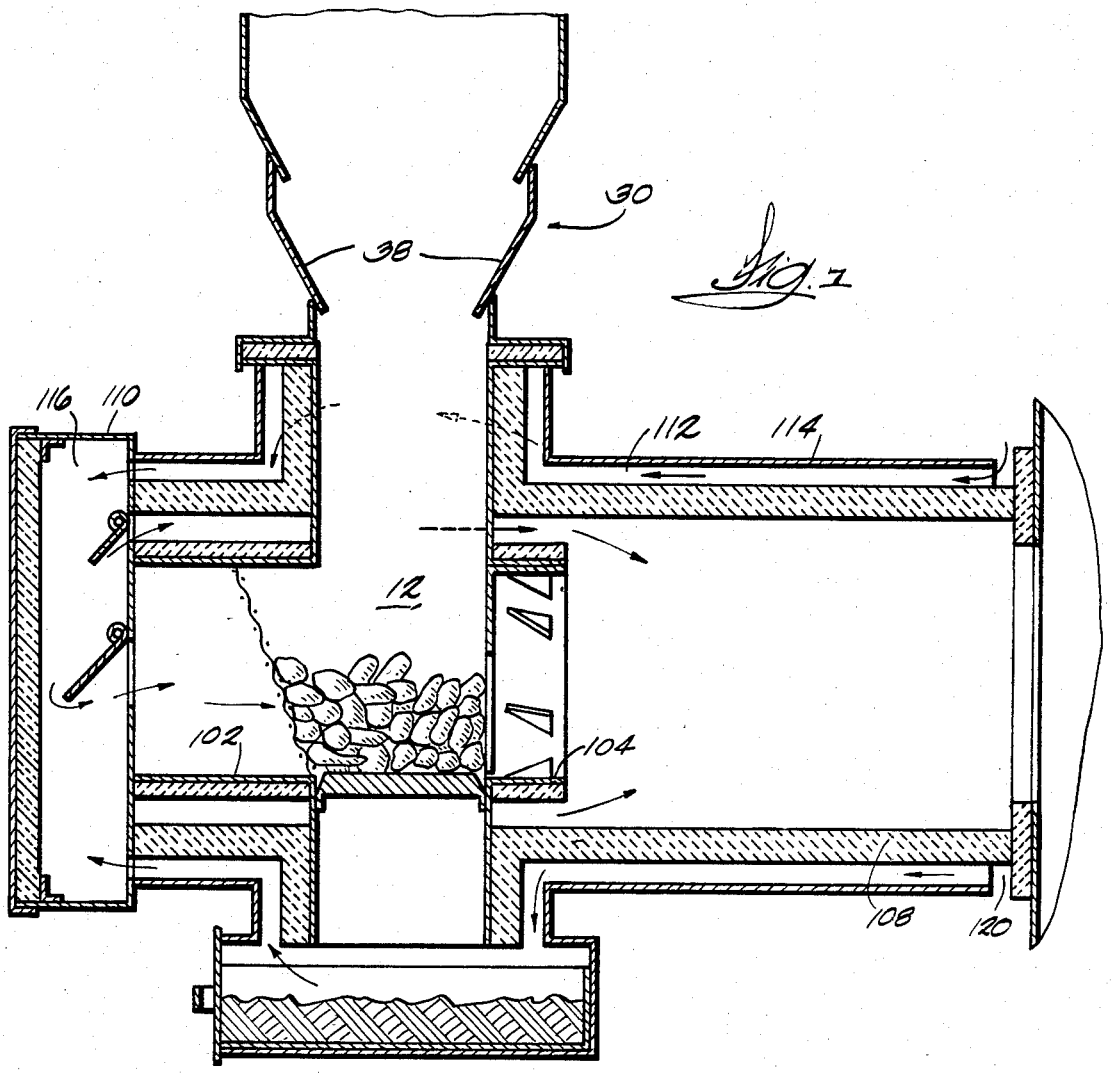
FIG. 7 is a cross section elevation view of a second embodiment of a furnace embodying the invention.
Figure 8:
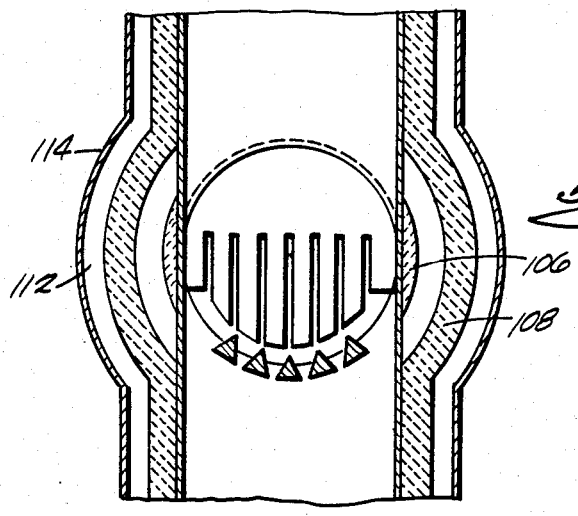
FIG. 8 is a cross section view taken generally along line 8—8 in FIG. 7.

FIGS. 7 and 8 illustrate an alternative embodiment of a furnace embodying the present invention. In that embodiment, the furnace operates in substantially the same manner as the furnace described above except that means are further added to cause the air entering the primary combustion zone to be preheated, and means are further added to retain the heat of combustion and increase the efficiency of operation of the furnace.

More particularly, in the construction shown in FIG. 7 the inner cylinder 102 is comprised of a combination of metal 104 and refractory material 106. Additionally the second cylinder or intermediate cylinder 108 is comprised of refractory material. This refractory material functions to retain heat within the primary and secondary combustion areas and increases the efficiency of operation of the furnace.

Means are also provided for preheating the air flowing into the primary combustion area by causing the incoming air to flow over the outside surface of the second cylinder 108. In the illustrated construction the inlet ends of the inner cylinder 102 and the second cylinder 108 are surrounded by a housing 110. An air space 112 is provided between the second cylinder 108 and an outer cylinder 114, and the air space 112 communicates with an air cavity 116 provided by the housing 110. Air enters the air space 112 at an annular opening 120 surrounding the hot air discharge end of the furnace.

In operation, the incoming air flows through the annular opening 120 into the air space 112. As the air moves along the length of the air space 112 it is heated by the second cylinder 108. This preheated air then passes into the chamber 116 where it will then flow into the combustion areas of the furnace. The movement of air through the air space 112 also functions to minimize the heat transferred to the cylinder 114.

Various features of the invention are set forth in the following claims.

I claim:

1. A furnace adapted to burn wood chips and wood particles, the furnace comprising an inner cylinder adapted to be positioned in horizontal relation and including opposite ends, and said inner cylinder housing a primary combustion area wherein wood particles are burned, one of said opposite ends comprising an air intake end, means for supporting a quantity of wood particles and for funneling wood particles into said primary combustion area, said means for supporting including a container adapted to house a quantity of wood particles, said container including a lower end having an opening adapted to deposit wood particles into said primary combusion area of said inner cylinder, a second cylinder including opposite ends, one of said ends surrounding said inner cylinder, said inner cylinder and said one of said ends of said second cylinder defining an air space therebetween, and the other of said opposite ends of said second cylinder defining a secondary combustion chamber, means for separating an upper portion of said air space from a lower portion of said air space, said means for separating including a first plate extending between one side of said inner cylinder to said second cylinder and a second plate extending between an opposite side of said inner cylinder and said second cylinder, one of said lower portion of said air space and said upper portion of said air space defining an air flow passage providing for air flow to said secondary combusion chamber.

2. A furnace as set forth in claim 1 and further including a means for controlling airflow through said inner cylinder.

3. A furnace as set forth in claim 2 and further including a means for controlling air flow through said air space between said inner cylinder and said second cylinder.

4. A furnace as set forth in claim 1 wherein said primary combustion area of said inner cylinder includes a lower portion, said lower portion including air flow passages between said lower portion of said air space and said primary combustion area for providing air flow from said lower portion of said air space into said primary combustion area.

5. A furnace as set forth in claim 2 wherein said means for controlling air flow through said inner cylinder from said air intake end comprises a door hingedly mounted adjacent said air intake end of said inner cylinder and moveable between an open position permitting air flow through said air intake end into said inner cylinder and a flow restricting position.

6. A furnace as set forth in claim 1 and further including means for providing air flow from said upper portion of said air space into said secondary combustion chamber to cause secondary combustion of exhaust gases in said secondary combustion chamber.

7. A furnace as set forth in claim 1 and further including a third cylinder surrounding said second cylinder and spaced outwardly from said second cylinder to define an air space between said second cylinder and said third cylinder.

8. A furnace as set forth in claim 1 wherein said container includes at least a pair of generally funnel shaped containers positioned in vertically stacked relation, said pair of funnel shaped containers including a lower container for supporting of first quantity of wood particles and an upper container for containing a second quantity of wood particles, said upper container being positioned on top of said lower container in vertically stacked relation.

9. A furnace as set forth in claim 8 wherein said lower container includes a plurality of downwardly sloping and converging lower sidewalls, said sidewalls including upper edges, and wherein said upper container includes a plurality of downwardly sloping and converging upper sidewalls, said upper sidewalls including lower edges, said lower edges of said upper sidewalls being housed in said lower container and being below said lower container and being below said lower sidewalls upper edges, and said upper sidewalls being supported on said upper edges.

10. A furnace adapted to burn wood chips and wood particles, the furnace comprising an inner cylinder adapted to be positioned in horizontal relation and including opposite ends, and said inner cylinder housing a primary combustion area wherein wood particles are burned, one of said opposite ends comprising an air intake end, means for supporting a quantity of wood particles and for funneling wood particles into said primary combustion area, said means for supporting including a container adapted to house a quantity of wood particles said container including a lower end having an opening adapted to deposit wood particles into said primary combustion area of said inner cylinder, a second cylinder including opposite ends, one of said ends surrounding said inner cylinder, said inner cylinder and said one of said ends of said second cylinder defining an air space therebetween, and the other of said opposite ends of said second cylinder defining a secondary combustion chamber, said air space defining an air flow passage for flow of air from adjacent said one of said opposite ends of said inner cylinder and along the length of said inner cylinder into said secondary combustion chamber.

11. A furnace as set forth in claim 10 and further including a means for controlling airflow through said inner cylinder.

12. A furnace as set forth in claim 11 and further including a means for controlling air flow through said air flow passage into said secondary combustion chamber.

13. A furnace as set forth in claim 10 and further including means for providing for air flow from a lower portion of said air space into said primary combustion area.

14. A furnace as set forth in claim 11 wherein said means for controlling air flow through said inner cylinder comprises a door hingedly mounted adjacent said air intake end of said inner cylinder and moveable between an open position permitting air flow through said air intake end into said inner cylinder and a flow restricting position.

15. A furnace as set forth in claim 10 and further including a third cylinder surrounding said second cylinder and spaced outwardly from said second cylinder to define an air space between said second cylinder and said third cylinder.

16. A furnace as set forth in claim 10 wherein said container includes at least a pair of generally funnel shaped containers positioned in vertically stacked relation, said pair of funnel shaped containers including a lower container for supporting of first quantity of wood particles and an upper container for containing a second quantity of wood particles, said upper container being positioned on top of said lower container in vertically stacked relation.

17. A combustion unit adapted to burn wood chips and wood particles, the combustion unit comprising an inner housing including opposite ends, and said inner housing including a primary combustion area wherein wood particles are burned, one of said opposite ends comprising an air intake end, means for supporting a quantity of wood particles and for funneling wood particles into said primary combustion area, said means for supporting including container means adapted to house a quantity of wood particles, said container means including a lower end having an opening adapted to deposit wood particles into said primary combustion area of said inner cylinder, a second housing including opposite ends, one of said ends surrounding said inner housing, said inner housing and said one of said ends of said second housing defining an air space therebetween, and the other of said opposite ends of said second housing defining a secondary combustion chamber, means for separating an upper portion of said air space from a lower portion of said air space, one of said upper portion of said air space and said lower portion of said air space providing an air flow passage to said secondary combustion chamber, said air flow in said air flow passage providing for air flow in the direction from said one of said ends of said second housing toward said other of said ends of said second housing into said secondary combustion chamber.

18. A combustion unit as set forth in claim 17 wherein said inner housing includes a lower portion, said lower portion including air flow passages between said lower portion of said air space and said primary combustion area for providing air flow from said lower portion of said air space into said primary combustion area.

19. A combustion unit as set forth in claim 17 wherein air flows through said upper portion of said air space into said secondary combustion chamber to cause secondary combustion of exhaust gases in said secondary combustion chamber.

20. A combustion unit as set forth in claim 17 wherein said container means includes at least a pair of generally funnel shaped containers positioned in vertically stacked relation, said pair of funnel shaped containers including a lower container for supporting of first quantity of wood particles and an upper container for containing a second quantity of wood particles, said upper container being positioned on top of said lower container in vertically stacked relation.

21. A combustion unit as set forth in claim 20 wherein said lower container includes a plurality of downwardly sloping and converging lower sidewalls, said sidewalls including upper edges, and wherein said upper container includes a plurality of downwardly sloping and converging upper sidewalls, said upper sidewalls including lower edges, said lower edges of said upper sidewalls being housed in said lower container and being below said lower container and being below said lower sidewalls upper edges, and said upper sidewalls being supported on said upper edges.

* * * * *